US005412972A

United States Patent [19]

Congelliere

[11] Patent Number: 5,412,972

[45] Date of Patent: May 9, 1995

[54] METHOD OF MAKING A GASKET

[75] Inventor: Peter Congelliere, Villa Park, Calif.

[73] Assignee: Crenshaw Die and Manufacturing Corporation, Orange, Calif.

[21] Appl. No.: 147,335

[22] Filed: Nov. 3, 1993

[51] Int. Cl.[6] ..... B21D 53/84; B21D 28/26

[52] U.S. Cl. ..... 72/333; 72/340; 29/888.3; 277/235 B

[58] Field of Search ..... 72/341, 333, 334, 379.2, 72/340; 29/888.3, 888; 277/235 B, 236

[56] References Cited

U.S. PATENT DOCUMENTS 3,707,933 1/1973 Berg ..... 72/341
5,106,107 4/1992 Justus ..... 277/235 B

FOREIGN PATENT DOCUMENTS 133473 5/1993 Japan ..... 277/235 B
309237 11/1955 Switzerland ..... 72/379.2

*Primary Examiner*—Daniel C. Crane

*Attorney, Agent, or Firm*—Hawes & Fischer

[57] ABSTRACT

The gasket and method of the present invention can be used for creating thinner surfaces on structures, including gaskets, without necessarily damaging such structures during formation, and without the need to resort to the undesirable practice of chemical milling. An annular ring is stamped to create an axially offset concentrically outward ring. The side of this ring which is displaced above the remainder of the annular ring is lathed off while the annular ring is securely attached to a lathe. The annular ring is secured at its inner and outer diameter during the facing operation to insure good support and that the work piece will not be harmed during processing. Further punching operations form apertures in the gasket while a small portion of axially offset material is left at the radial extent of the gasket. Finally, this axially offset material is punched away, and the gasket is made available for further finishing operations such as sand blasting.

15 Claims, 5 Drawing Sheets

METHOD OF MAKING A GASKET

FIELD OF THE INVENTION

The present invention relates to the field of metal parts and methods for making metal parts. More specifically, the present invention relates to a method for making gaskets and the gaskets made using such method.

BACKGROUND OF THE INVENTION

Gaskets are generally sealing members which are utilized to form a sealing interface between two or more structures. Gaskets are available in range of hardnesses from pliant to rigid. Gaskets made from non-pliant materials, including metals are generally more difficult to make. One of the more difficult gaskets to make is commercially available as GASK-O-SEAL, and is typically used in diesel engines of the type commonly employed in diesel-electric trains.

This gasket is angularly shaped, and has a thick area along its radially inward surface, and a thin area along its radially outward surface. The radially outward surface also contains a series of two types of apertures. One set of apertures is round, and the other have a shape facilitating the placement of inserts. In addition, the radially outward surface has orientation notches to assist in orienting the gasket.

The preferred method of production has been to start with a sheet of cold rolled steel, mask off the areas which are to remain relatively thick, and chemically mill the areas whose thickness are to be reduced. Chemical milling involves the immersion of the part into a bath having an acid or other chemical agent of known strength and reaction rate. The part is typically exposed to the bath for a predetermined amount of time to hopefully result in the removal of a pre-determined amount of the metal, the theory being that the chemical milling bath with cause the removal of the metal evenly. Chemical milling is especially used for very thin parts, since the chemical milling process does not produce harmful forces which might cause thin parts to tear and bend. Chemical milling has been used with gaskets because it was sought to remove material evenly from both sides of the circumferentially outward portion of the gasket.

This method of production has resulted in several production problems. The rejection rate for this method is about fifty percent. Further, chemical milling is not an environmentally sound method. The chemical milling solution is caustic and may not easily be converted to inert compounds after its use. Chemical milling solutions contain heavy metals which are a hazardous waste. Even if the metals can be removed using electrical or chemical methods, these additional process steps drive up the cost, and the chemical milling solution must eventually be disposed.

Further, some caustic chemical milling solutions can invade, attack and change the chemical structure of certain metals. The performance of chemical milling with an improper solution could result in unwanted brittleness, unwanted crystalline defects, or uneven dissolution.

What is needed is a process for making metal and non-pliant gaskets which does not involve chemical milling. The method should result in a minimum amount of metallic scrap, and the scrap which is produced should be amenable to immediate recycling. The needed process should be able to make a product which is consistently of high quality, has zero defects, and which absolutely minimizes the rejection and error rates in manufacturing.

SUMMARY OF THE INVENTION

The gasket and method of the present invention can be used for creating thinner surfaces on structures without necessarily damaging such structures during formation, and without the need to resort to the undesirable practice of chemical milling. An annular ring is stamped to create an axially offset concentrically outward ring. The side of this ring which is displaced above the remainder of the annular ring is lathed off while the annular ring is securely attached to a lathe. The annular ring is secured at its inner and outer diameter during a facing operation, in which the face of the annular ring is cut away, to insure good support and that the work piece will not be harmed during processing.

Further punching operations form apertures in the gasket while a small portion of axially offset material is left at the radial extent of the gasket. Finally, this axially offset material is punched away, and the gasket is made available for further finishing operations such as sand blasting.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
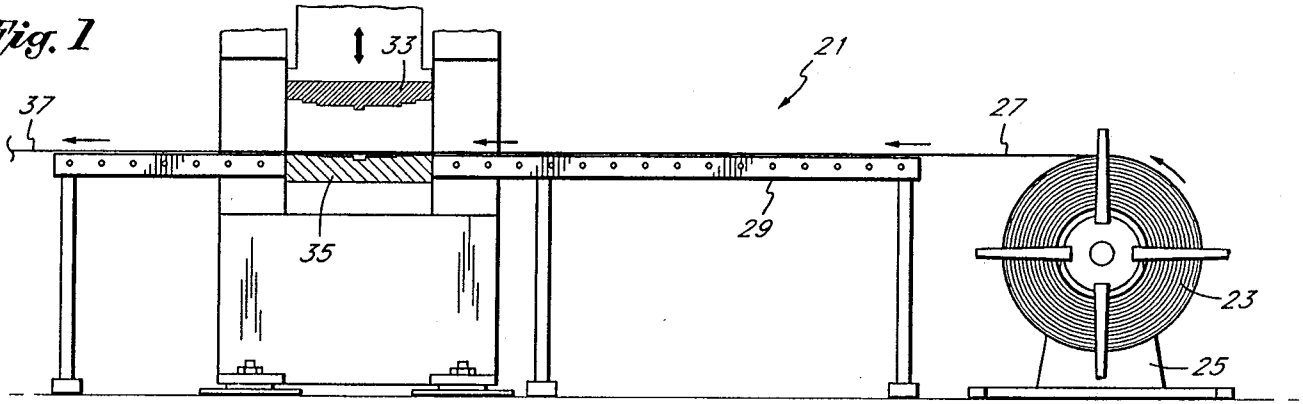
FIG. 1 is a plan view of an assembly line illustrating a first punching step in the process where a roll of sheet steel is converted to an annular ring.

The description and operation of the invention will be best described with reference to FIG. 1. FIG. 1 is a plan view of what may be an automated punching operation 21. A coil 23 of sheet steel is rotatably supported to rotate about a horizontal axis by a base support 25. As the coil 23 of sheet steel unwinds, the steel sheet 27 is passed over a support 29 on its way to a first punch press 31. Punch press 31 supports and drives an upper die 33 against a lower die 35.

This first punching operation shown in FIG. 1 may be automated to run continuously. A circular shape will be punched out of the sheet 27 leaving a web 37 which is shown travelling in a direction downstream of the punch press 31. This web 37 may be engaged at a point downstream of the punch press 31 to assist in pulling fresh areas of sheet 27 into position under the punch press 31, as well as to measure the exact amount of advance of sheet 27 to maximize the utilization of the sheet 27.

Figure 2:
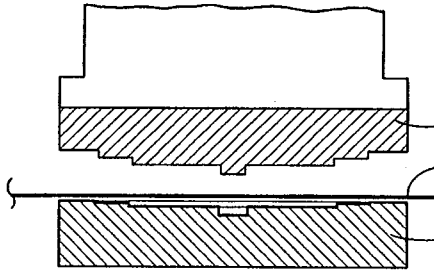
FIG. 2 is a cross sectional view of the punching operation which is carried on in the first punching step shown an FIG. 1.
Figure 3:
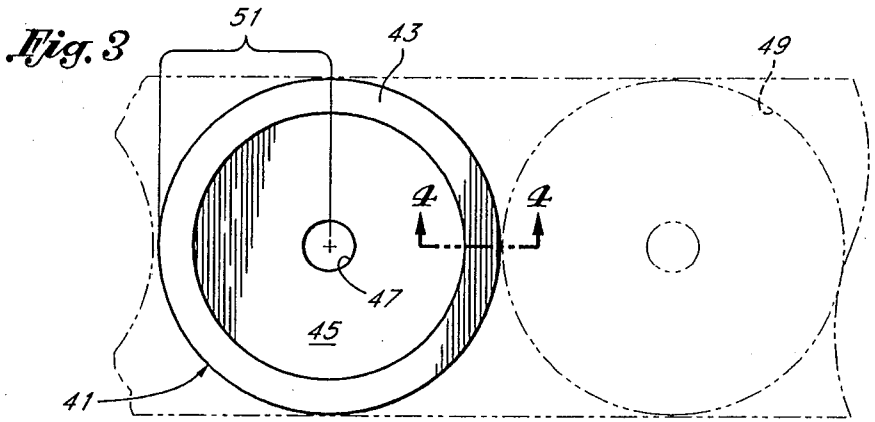
FIG. 3 is a plan view of an annular ring having an offset concentrically outwardly portion, shown within the context of the sheet of steel from which it was punched.

Referring to FIG. 2, an expanded view of the upper die 33 and lower die 35 is shown, to emphasize the shapes which are formed in the sheet 27 as it undergoes punching from the first punch press 31. With reference also to FIG. 3, the extent of the processing is apparent. The first stamping operation produces an annular disk 41 having, an offset (before lathing) concentrically outward portion 43, a concentrically inward portion 45 and a center aperture 47. In FIG. 3, in dashed line format, the sheet 27 from which the annular disk 41 was stamped is shown with respect to annular disk 41, and an adjacent annular disk outline 49. As is shown, the manufacturing operation is quite efficient with significantly no wasted metal sheet 27 between adjacent annular disks 41, as well as a minimum amount of metal sheet 27 to the sides of the annular disks 41. The scrap, consisting of the portions of sheet 27 not converted to annular disk 41, may be recovered for re-processing. This would not be the case if chemical milling were used.

As is shown in FIG. 2, a portion of the upper die 33 is pronounced enough to form the aperture 47. The other portions of the upper die 33 are less pronounced, but will, in concert with lower die 35, cause the annular disk 41 to be cut from the sheet 27, and to form the offset concentrically outward portion 42.

Figure 4:
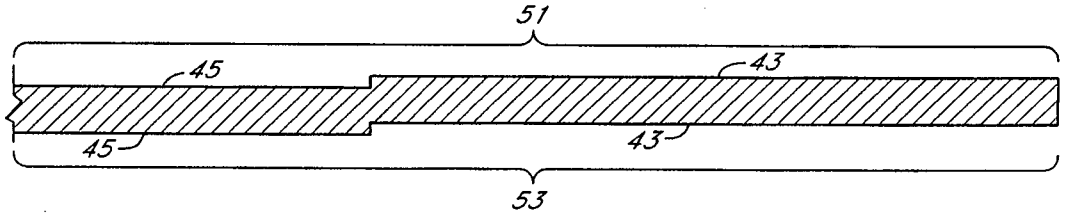
FIG. 4 is a cross section taken along line 4—4 of FIG. 3 and illustrating the extent to which said concentrically outwardly portion is offset.

FIG. 4 illustrates a sectional view along line 4—4 of FIG. 3. The view shown in FIG. 3 is that of the first side, wherein the concentrically outward portion 43 is raised axially with respect to the level of the concentrically inward portion 45. The first side is referred to as 51 and is shown in FIG. 3 and in FIG. 4. A second side 53 is shown in FIG. 4. The stamping operation produces a high shear force at the transition line between the concentrically outward portion 43 and the concentrically inward portion 45. This transition zone can be quite sharp.

Figure 5:
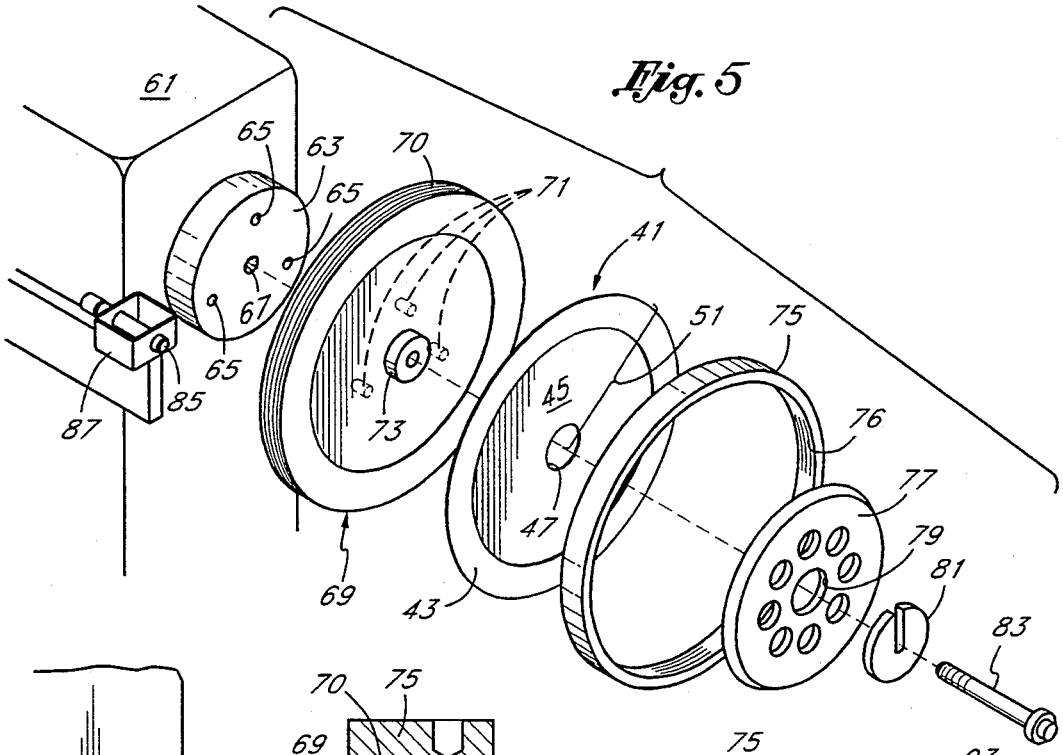
FIG. 5 is an exploded view of the annular ring of FIGS. 2 and 3 as it fits upon a lathe support which holds the annular ring during the facing operation.

A pre-determined depth of the concentrically outward portion 43 of first side 51 will be removed as it is faced in the apparatus shown in FIG. 5. FIG. 5 illustrates a lathe 61 having a face plate 63 which may have a series of spaced structures 65 surrounding a threaded aperture 67. An arbor 69, also known as a "face plate," having radially, externally disposed threads 70, fits against the face plate 63 and may have a corresponding set of structures 71 (shown in phantom) engageable with the structures 65 to insure that the threaded arbor 69 turns with the face plate 63. Arbor 69 has a boss 73 which fits through the aperture 47 when the annular disk 41 is fitted against the arbor 69.

As is shown in FIG. 5, the second side 53 (not shown) fits against the arbor 69, while the first side 51 faces away from the arbor 69. Further, the arbor 69 has a surface complementary to the second side 53 to further evenly support and engage the annular disk 41. Adjacent the annular disk 41 fits an internally threaded clamping ring 75 having internal threads 76. The threads 76 match the threads 70 and will allow for a one-quarter turn locking of the clamping ring 75 onto the arbor 69. Such a threaded arrangement minimizes time required during the facing operation, and minimizes the potential for difficulty in properly aligning the threads or for cross threading. An inside clamping ring 77 will engage the face of the annular disk 41, and has a central aperture 79 which will accommodate the boss 73.

Figure 6:
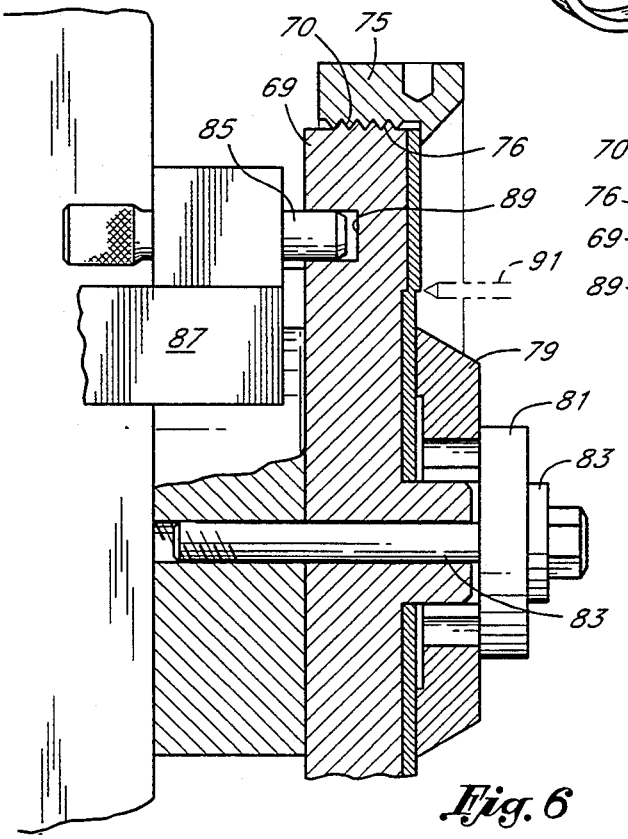
FIG. 6 is a side sectional view of the assembled lathe support of FIG. 5 and illustrated in position for lathing to occur.

A slotted washer 81 is engaged with a draw bolt 83 which engages the internal portion of the threaded aperture 67. A spring loaded pin 85 is supported by a guide structure 87 on the lathe 61, which engages a bore 89 in the rear portion of the arbor 69. This is best shown in FIG. 6, where bore 89 is shown more completely. The pin 85 is used to engage the arbor 69 to prevent arbor 69 from turning while an operator is applying torque forces to the arbor 69 and structures attached thereto during the set-up and changing of the annular disk 41. Adjacent the annular disk 41 fits an internally threaded clamping ring 75 having internal threads 76. The threads 76 match the threads 70 and will allow for a one-quarter turn locking of the clamping ring 75 onto the arbor 69. Such a threaded arrangement minimizes time required during the facing operation, and minimizes the potential for difficulty in properly aligning the threads or for cross threading. An inside clamping ring 77 will engage the face of the annular disk 41, and has a central aperture 79 which will accommodate the boss 73.

A slotted washer 81 is engaged with a draw bolt 83 which engages the internal portion of the threaded aperture 67. A spring loaded pin 85 is supported by a guide structure 87 on the lathe 61, which engages a bore 89 in the rear portion of the arbor 69. This is best shown in FIG. 6, where bore 89 is shown more completely. The pin 85 is used to engage the arbor 69 to prevent arbor 69 from turning while an operator is applying torque forces to the arbor 69 and structures attached thereto during the set-up and changing of the annular disk 41 FIG. 6 shows a cross section of the assembled structures which were shown in exploded relationship in FIG. 5. Also shown, in phantom is a cutting tool bit 91 with which the material on the concentrically outward portion 43 will be removed.

The level of the concentrically outward portion 43 will be reduced to a level below the level of the concentrically inward portion 45, with respect to the first side 51. With respect to the second side 53, the first stamping operation has already reduced the level of the concentrically outward portion 43 with respect to the level of the concentrically inward portion 45. Note in FIG. 6 how the differences in the levels of the concentrically outward portion 43 with respect to the level of the concentrically inward portion 45 is accommodated by the arbor 69. Note also the threaded engagement of the internally threaded clamping ring 75 to a threaded exterior portion of the arbor 69.

Figure 7:
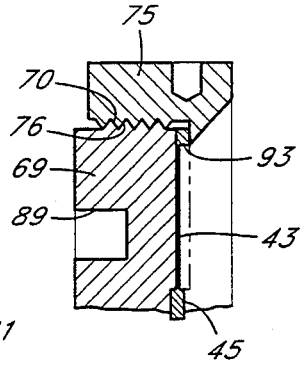
FIG. 7 is a side sectional view of the concentrically outwardly portion of the annular disk as it appears after lathing has occurred, and showing the unlathed extreme outer portion.

Referring to FIG. 7, a portion of the cross sectional view of FIG. 6 is shown as it would appear after the facing operation is complete. Note that the remaining structure includes the concentrically inward portion 45, the concentrically outward portion 43 which has been reduced to a very thin dimension and is represented by a thickened black line. An offset outer rim portion 93 remains, which has a thickness equal to the thickness of the metal sheet 27, which is equal to the thickness of the concentrically inward portion 45, but which is still offset with respect to concentrically inward portion 45.

Figure 8:
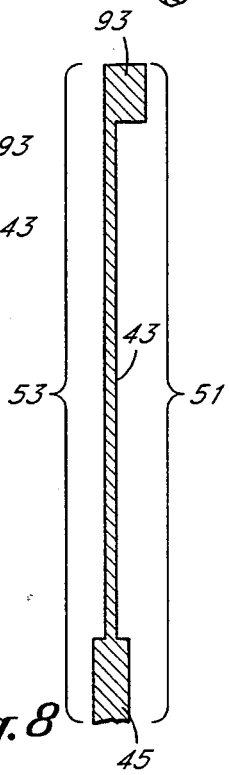
FIG. 8 illustrates an expanded view of the edge of the annular disk of FIG. 7 after lathing has occurred.

The preferable dimension of the metal sheet 27 was 0.020±0.001 inches. The remaining dimensional thickness of the thin concentrically outward portion 43 shown in FIG. 7 is about 0.010 inches. Ideally, the concentrically outward portion 43 will be axially centered with respect to the concentrically inward portion 45, and the axial center of both will be in the same plane. Of course, it is not mandatory, especially for applications where an offset is required. Referring to FIG. 8, an expanded cross sectional view of the annular disk 41 shows the offset outer rim portion 93, the concentrically inward portion 45, and the concentrically outward portion 43.

Figure 9:
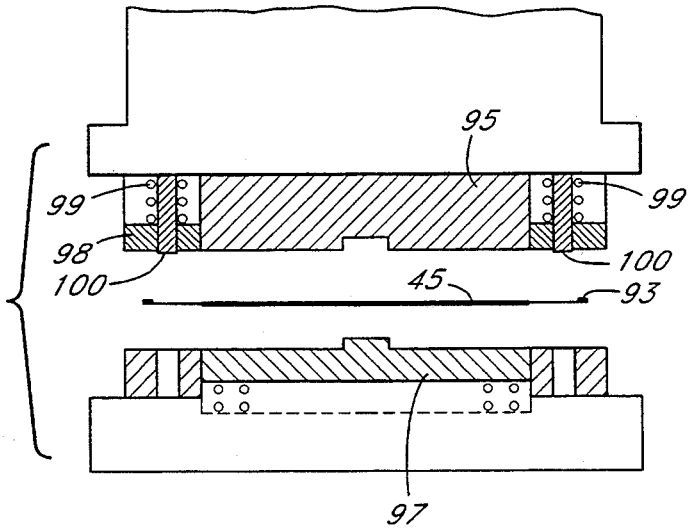
FIG. 9 illustrates a cross sectional view of a second punching operation which is used to pierce the lathed annular ring of FIGS. 3–8 with a series of apertures adjacent the outer periphery thereof.

Once it has been lathed, the annular disk 41 is removed from the lathe 61 of FIGS. 5 and 6 and subjected to a second press operation shown in FIG. 9. FIG. 9 illustrates the annular disk 41 between an upper die 95 and a lower die 97. The purpose of the stamping operation is to stamp a series of apertures into the concentrically outward portion 43.

Figure 10:
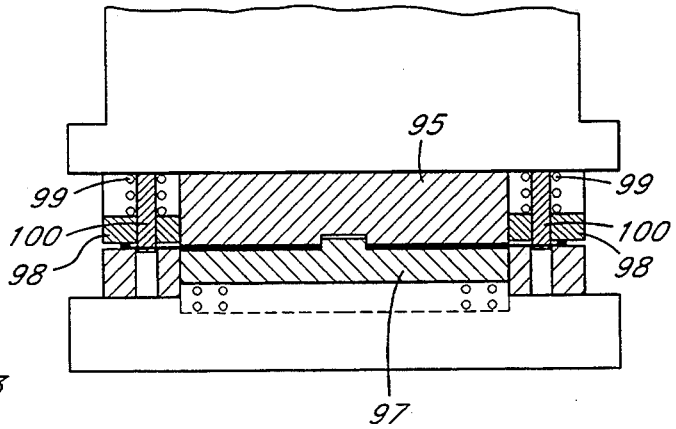
FIG. 10 illustrates the punch press of FIG. 9, but in a closed position.
Figure 11:
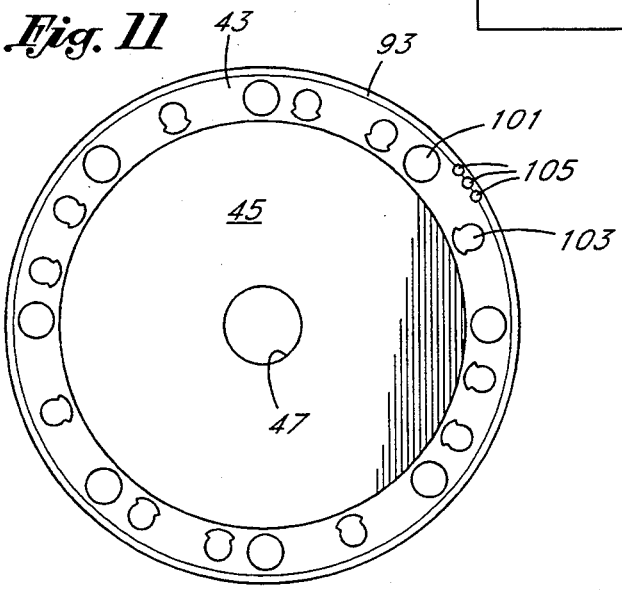
FIG. 11 is a plan view of the lathed annular ring of FIGS. 3–9 after the punched formation of apertures.

Upper die 95 includes a stripper plate 98 which is biased by springs 99. The individual punch members 100 are surrounded by the springs 99, and are enabled to extend beyond the lower surface of the stripper plate 98. The action of the stripper plate 98 is to push down on the annular disk 41 after the punching has taken place to prevent the annular disk 41 from being lifted up by the upper die 95 after the punching operation. Such actions may damage the annular disk 41, and would inhibit the smooth flow of punching operations. In FIG. 10, the press shown in FIG. 9 is shown in the closed position. The apertures being punched in the illustration of FIG. 10 are of three types, and FIG. 11 shows the annular disk 41 as it appears after the result of the stamping operation of FIGS. 9 and 10.

The concentrically outward portion 43 contains large circular apertures 101, and insert apertures 103, in addition to a set of three small alignment apertures 105, which will become alignment notches, as will be shown. After the stamping operation of FIGS. 9 and 10, the offset outer rim portion 93 remains. Note that the alignment apertures 105 have radii which lie along, or bisect, the line of transition from the offset outer rim portion 93 and the concentrically outward portion 43. This is not an absolute requirement, and the radii of the alignment apertures may lie concentrically further from the concentrically outward portion 42 to leave a lesser radial inset into the concentrically outward portion 42 once the offset outer rim 93 is removed.

Figure 12:
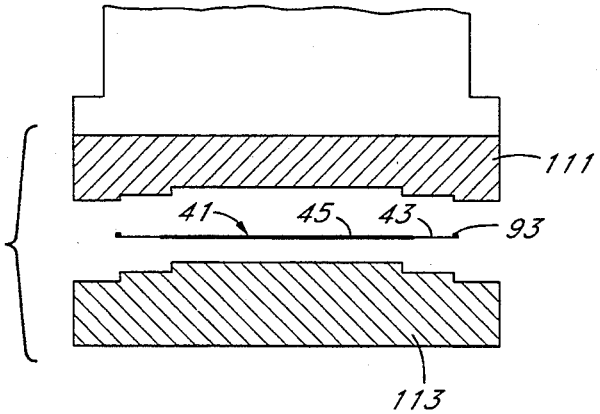
FIG. 12 illustrates a cross sectional view of a third punching operation which is used to remove a narrow strip of material at the extreme periphery of the lathed annular ring of FIG. 3–10.
Figure 13:
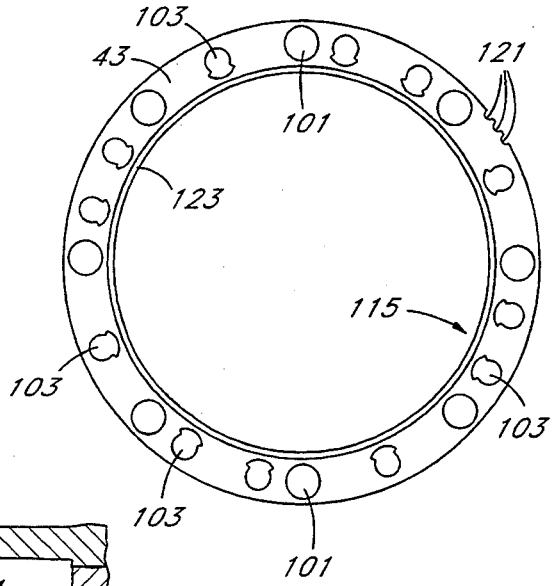
FIG. 13 is a plan view of a gasket formed from the lathed annular ring of FIGS. 3–12 after the removal of the narrow strip of material.

Referring to FIG. 12, a final stamping operation is employed to remove the offset outer rim portion 93, and to remove the bulk of the concentrically inward portion 45 which contained the aperture 47. An upper die 111 is configured with respect to a lower die 113 to cleanly shear away the offset outer rim portion 93. FIG. 13 shows what has become gasket 115, and which used to be the annular disk 43 as was shown in FIG. 11.

Alignment apertures 105 have become alignment notches 121. Removal of the bulk of the concentrically inward portion 45 has been accomplished to leave a relatively narrow width of concentrically inward material 123 which will be utilized as a gasket 115 sealing face. The gasket 115, as it appears in FIG. 13 is complete in terms of its bulk removal, and is ready for finishing.

Figure 14:
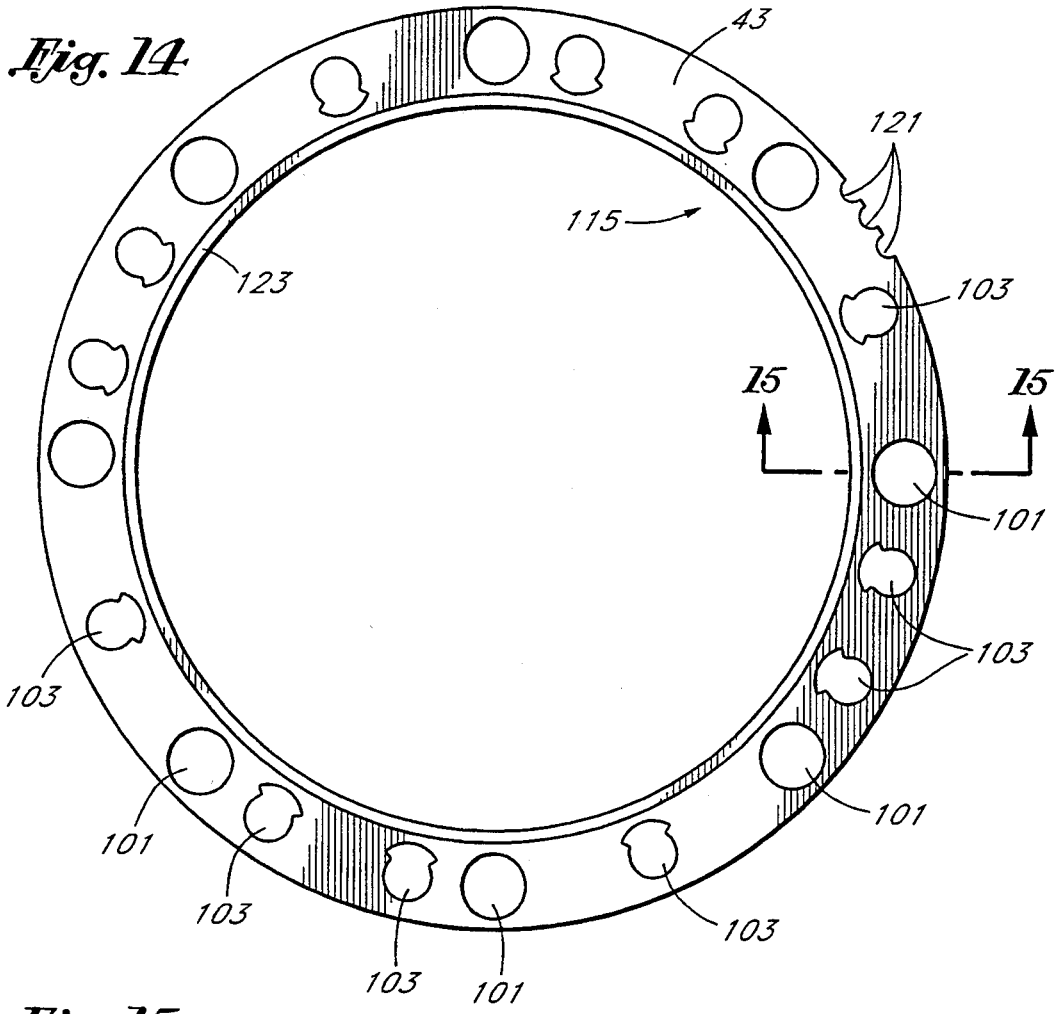
FIG. 14 is a an expanded plan view of the gasket of FIG. 13.
Figure 15:
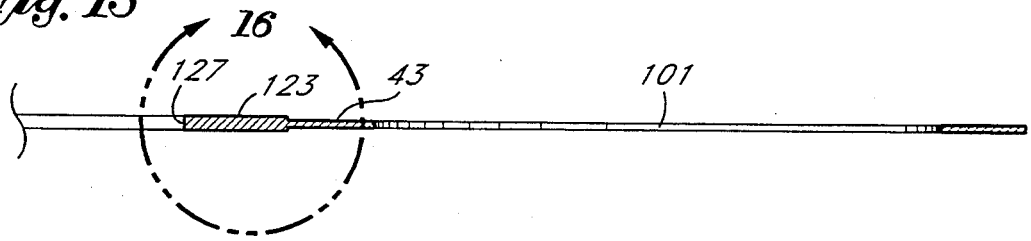
FIG. 15 is a sectional view taken along line 15—15 of FIG. 14 of a width of the gasket of FIGS. 13 and 14.
Figure 16:
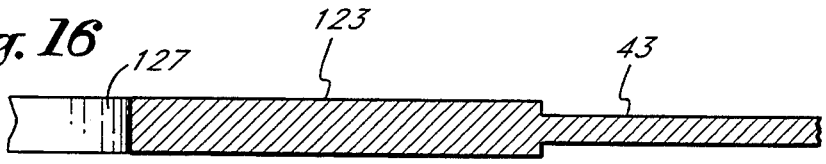
FIG. 16 is an expanded sectional view taken about area 16—16 of FIG. 15 of the gasket of FIGS. 13–15.

Referring to FIGS. 14–16, expanded views of the gasket 115 further illustrate details of its construction. In FIG. 14, the relatively narrow width of concentrically inward material 123 is more readily seen and is distinguished with respect to the concentrically outward portion 43. Referring to FIG. 15, a cross sectional view is taken along line 15—15 of FIG. 14 which illustrates the relative thickness of the material of the gasket 115. From the left we see the beginning of the concentrically outward portion 43 at the outer edge of the aperture 101.

Aperture 101 is present dividing the sectional views of the concentrically outward portion 43 which begin at an outer edge 125 of the aperture 101, and ends at the transition to the concentrically inward material 123. Concentrically inward material 123 ends at an inner edge 127 which extends about the inner circumference of the concentrically inward material 123.

Referring to FIG. 16, an expanded view of the transition area from the concentrically inward material 123 to the concentrically outward portion 43 is illustrated. The concentrically inward material 123 forms a portion of the gasket 115 known as the fire ring. As previously stated, it has a thickness of about 0.020 inches. The adjacent concentrically outward portion 43 has a thickness of about 0.010 inches. Here, it is shown that the center axis of the concentrically outward portion 43 of the material coincides with the center axis of the concentrically inward portion 123 of material, meaning that they are symmetrically distributed about a common plane normal to the axis of the gasket 115.

Figure 17:
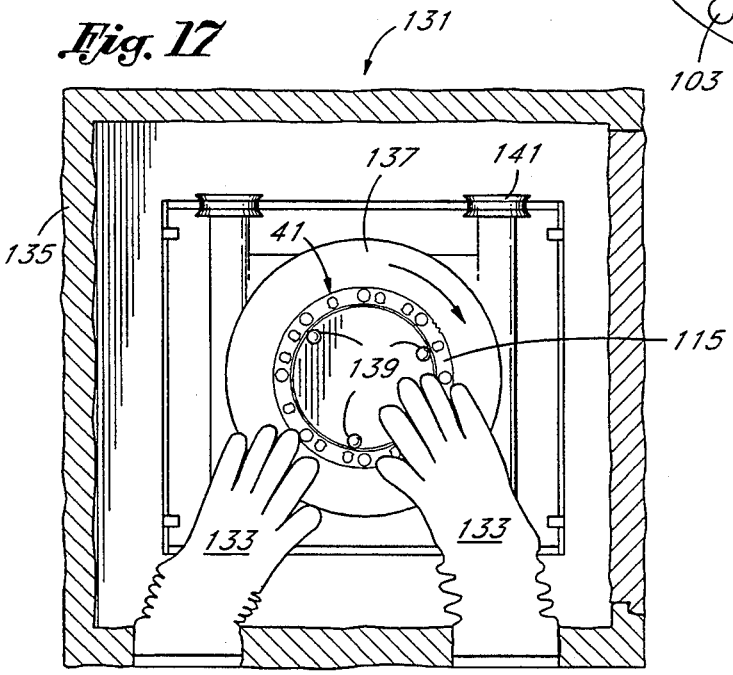
FIG. 17 is an upper view of one setup in which the gasket shown in FIGS. 13–16 may undergo further finishing, such as sand blasting.

Referring to FIG. 17, a sand blasting station 131 is shown. The view shown is one from above, in which a pair of gloves 133 are shown extending into the confines of a glove box 135 in which sand blasting will occur. The gasket 115 is mounted on a round table support 137 and centered on the round table support 137 with a set of three locating pins 139. The support 137 is rotatable to facilitate sand blasting at all angles and to facilitate the viewing of all sides. Round table support 137 may be supported by wheels 141 to facilitate side to side translation of the gasket 115.

While the present invention has been described in terms of a gasket, one skilled in the art will realize that the structure and techniques of the present invention can be applied to many structures. The present invention may be applied in any situation where stamping can be combined with lathe type material removal to yield a part having different thicknesses.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A process of forming a gasket comprising the steps of:

providing a first disk having an aperture track of relatively thin material and comprising a plurality of apertures, the axis of each aperture perpendicular to the surface thereof bounded by a radially inward thicker portion and a radially outward thicker portion;

punching said radially outward thicker portion away; and punching away a portion of said radially inward thicker portion.

2. The process of forming a gasket as recited in claim 1 wherein said punching steps are done simultaneously.

3. The process of forming a gasket as recited in claim 1 wherein a series of three adjacent alignment apertures whose center points lie along a line of radial transition of the aperture track and the radially outward thicker portion.

4. The process of forming a gasket as recited in claim 1 wherein said disk has a pilot hole at the center of the radially inward thick portion.

5. The process of forming a gasket as recited in claim 1 wherein said aperture track and said radially inward portion are centered about a common plane.

6. The process of forming a gasket as recited in claim 1 wherein said radially outward thicker portion is axially offset with respect to said radially inward thicker portion.

7. The process of forming a gasket as recited in claim 1 wherein said providing a first disk step further comprises the steps of:

providing a second disk having a radially inward portion and a radially outer portion being axially offset; and facing a portion of said radially outer portion of said disk from a point at the inner most radius of said offset to a radial distance less than the radius of said disk forming an axially centered thinner portion, to thereby form said first disk.

8. The process of forming a gasket as recited in claim 7 wherein said facing operation is performed by the steps of:

securing said disk to an arbor with a planar clamping ring, said arbor having radially outwardly disposed threads;

securing the outer periphery to said arbor with an internally threaded annular clamping ring having threads engageable with said radially outwardly disposed threads of said arbor; and circumferentially cutting away a face of said offset portion of said radially outer portion of said disk.

9. The process of forming a gasket as recited in claim 7 further comprising the step of:

providing a third disk having an aperture track of relatively thin material bounded by radially inward thicker portion and a radially outward thicker portion, punching a plurality of apertures into the aperture track which are perpendicular to the surface of said disk, to thereby form said second disk.

10. The process of forming a gasket as recited in claim 9 wherein said providing a third disk step further comprises the steps of:

providing a sheet of material having a first side and second side;

punching a disk from said sheet of material having a first side and a second side;

forming a step in said disk such that said first side has a radially outward portion which is relatively lower compared to a radially inward portion and said second side having a radially outward portion relatively higher than a relatively inward portion.

11. The process of forming a gasket as recited in claim 10 wherein the punching and forming steps are done simultaneously.

12. The process of forming a gasket as recited in claim 10 further comprising the step of punching out a center portion from said disk.

13. The process of forming a gasket as recited in claim 1 further comprising the step of sandblasting the disk.

14. A process of forming a gasket comprising the steps of:

providing a disk having a first side and a second side said disk being offset in the direction of said second side such that said offset is a radially outer portion of said disk;

facing said second side from said offset in a radially outward direction to a point short of the outermost radius to form a faced portion, said faced portion being the same axial distance from the axial center of said disk as the offset portion of said first side whereby the unfaced portion of the second side at said periphery and the radially inward portion are thicker than said faced portion.

15. The process of forming a gasket as set forth in claim 14 further comprising the steps of:

punching said outer peripheral portion away; and punching away a portion of said radially inward thicker portion.

* * * * *